US007367162B2

(12) United States Patent
Lucci

(10) Patent No.: US 7,367,162 B2
(45) Date of Patent: May 6, 2008

(54) SYSTEM FOR SHOE LATCHING IN LATERALLY REMOVABLE SASH

(75) Inventor: Robert Michael Lucci, Rochester, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 11/011,288

(22) Filed: Dec. 14, 2004

(65) Prior Publication Data

US 2005/0166461 A1 Aug. 4, 2005

(51) Int. Cl.
*E05D 15/02* (2006.01)

(52) U.S. Cl. ..... 49/453; 49/446; 49/445

(58) Field of Classification Search ..... 49/176, 49/181, 187, 446, 445, 447, 453; 16/200, 16/DIG. 16

See application file for complete search history.

(56) References Cited

U.S. PATENT DOCUMENTS

| | | | | | |
|---|---|---|---|---|---|
| 569,146 | A | | 10/1896 | Barry | |
| 660,438 | A | | 10/1900 | Holly | |
| 1,932,906 | A | * | 10/1933 | Caldwell et al. | 16/202 |
| 2,217,543 | A | | 10/1940 | Gaines et al. | |
| 2,791,795 | A | | 5/1957 | Haas | |
| 2,796,630 | A | * | 6/1957 | Haas | 49/430 |
| 2,903,736 | A | * | 9/1959 | Osten, Sr. | 16/197 |
| 2,987,758 | A | | 6/1961 | Osten, Sr. | |
| 3,010,163 | A | * | 11/1961 | Osten, Sr. | 49/430 |
| 3,183,559 | A | | 5/1965 | Love | |
| 3,197,819 | A | | 8/1965 | Trout | |
| 3,206,795 | A | | 9/1965 | Weidner | |
| 3,271,812 | A | | 9/1966 | Skolnik | |
| 3,280,511 | A | | 10/1966 | Johnson | |
| 3,407,434 | A | | 10/1968 | Scott | |
| 3,434,236 | A | | 3/1969 | Weidner et al. | |
| 3,441,978 | A | | 5/1969 | Perry | |
| 3,499,248 | A | * | 3/1970 | Baer | 49/430 |
| 4,245,436 | A | | 1/1981 | Riegelman et al. | |
| 4,271,631 | A | * | 6/1981 | Trout | 49/181 |
| 4,800,680 | A | | 1/1989 | Westfall et al. | |
| 4,885,871 | A | * | 12/1989 | Westfall et al. | 49/176 |
| 5,189,838 | A | | 3/1993 | Westfall | |
| 5,231,795 | A | | 8/1993 | Westfall | |
| 5,542,212 | A | * | 8/1996 | Erickson et al. | 49/181 |
| 5,572,828 | A | | 11/1996 | Westfall | |
| 2004/0065016 | A1 | | 4/2004 | Malek | |

FOREIGN PATENT DOCUMENTS

| | | |
|---|---|---|
| DE | 2046109 | 1/1973 |
| EP | 0509943 | 10/1992 |
| FR | 2718486 | 10/1995 |
| GB | 0729287 | 5/1955 |
| GB | 1002338 | 8/1965 |

* cited by examiner

*Primary Examiner*—Gregory J. Strimbu
(74) *Attorney, Agent, or Firm*—Brown & Michaels, PC

(57) ABSTRACT

A system for supporting a window sash that allows for the removal of the sash from between opposed window jambs. The system supports the window sash through counterbalance shoes supporting sash support arms pivotally attached to the sash. The shoes include hooks which, in first positions, engage lances in the window jambs to hold the shoes in place as the sash is removed from or installed between the window lambs. The hooks, in second positions, engage pins extending from the support arms to retain the support arms on the shoes.

20 Claims, 13 Drawing Sheets

SYSTEM FOR SHOE LATCHING IN LATERALLY REMOVABLE SASH

FIELD OF THE INVENTION

Figure 1:
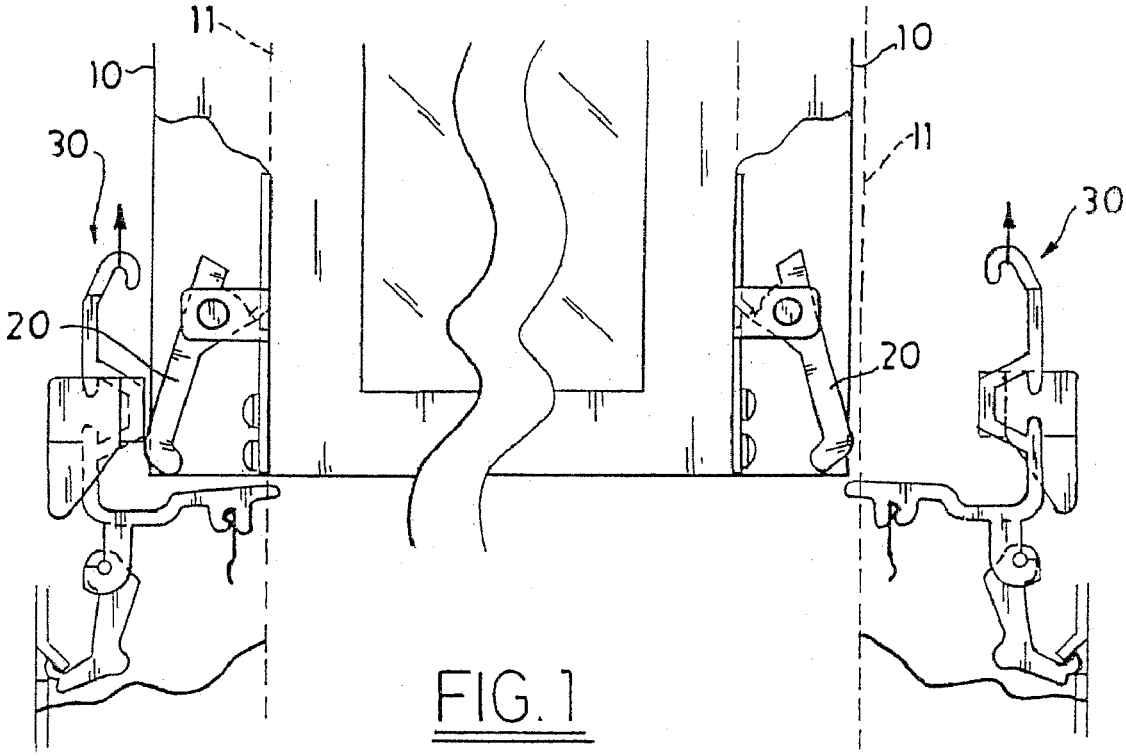

Support and counterbalancing of heavy sash that are laterally removable from between opposed jambs of a window.

BACKGROUND

Large and heavy window sash, such as those used in schools, offices, and institutional buildings, move vertically between opposed pairs of jambs that are generally extruded of metal. A sash for such a window can weigh over 100 pounds so that a counterbalance system for shoes supporting such a sash must exert a corresponding upward lift. Locking the support shoes of the counterbalance system within the jambs must be secure and reliable, because of the large spring forces involved. Also, the sash support must make a heavy sash easy to raise and lower, and removal and replacement of a sash must be convenient and reliable. Since such windows are often used in schools, the counterbalance support system must also be tamper resistant to the manipulations of curious children. Besides these requirements, an effective window system must accomplish all the necessary functions in a reliable way with elements that are inexpensive to manufacture and maintain.

This invention improves upon solutions proposed in application Ser. No. 08/839,161 (the aforementioned application being hereby incorporated by reference), now U.S. Pat. No. 6,948,279 B1, and U.S. Pat. No. 5,231,795 for supporting and counterbalancing a heavy sash that is laterally removable from between opposed jambs of a window. The sash counterbalancing and removal problem is the same one addressed in the '795 patent and the '279 patent, but the new solution of this invention offers improvements on the performance provided by the '279 patent and the '795 patent.

SUMMARY OF THE INVENTION

As in U.S. Pat. No. 6,948,279 the instant system for support of a sash that is laterally removable from between opposed window jambs uses sash support arms that are movably arranged for transferring the weight of the sash to the shoes and for bridging distances between the sash stiles and the shoes. When not supporting the weight of the sash, the support arms move to positions that allow the sash to be lifted off of counterbalance support shoes and laterally removed from between the window jambs and conversely reinserted between window jambs and lowered onto the shoes. This is done while the shoes are locked in positions within the window jambs. When the support arms support the weight of the sash, they are in positions that rest the sash weight on the counterbalance shoes to support the weight of the sash.

The counterbalance shoes, which are biased upwardly by counterbalance springs, cooperate with the sash support arms. The shoes receive and support the sash weight transferred to the shoes by the sash support arms, and the shoes have hooks that can be deployed to lock the shoes reliably in the jambs by engaging projections formed in the jambs for this purpose. An improvement taught in the instant application is the provision of support arm latching members on the hooks in the form of rear extensions that latch over interlock pins extending from the support arms when the hooks are disengaged from the jambs. Thus, as taught herein, the same hook elements that serve to hold the shoes in position when engaged to the jambs serve to further secure the support arms for the sash in position on the shoes when disengaged from the jambs.

DRAWINGS

FIGS. 1 through 5 illustrate a basic embodiment for a system for shoe latching in laterally removable sash in accordance with the teachings of U.S. Pat. No. 6,948,279 and are included for the basic understanding of the underlying system and workings of the instant invention provided thereby.

Figure 2:
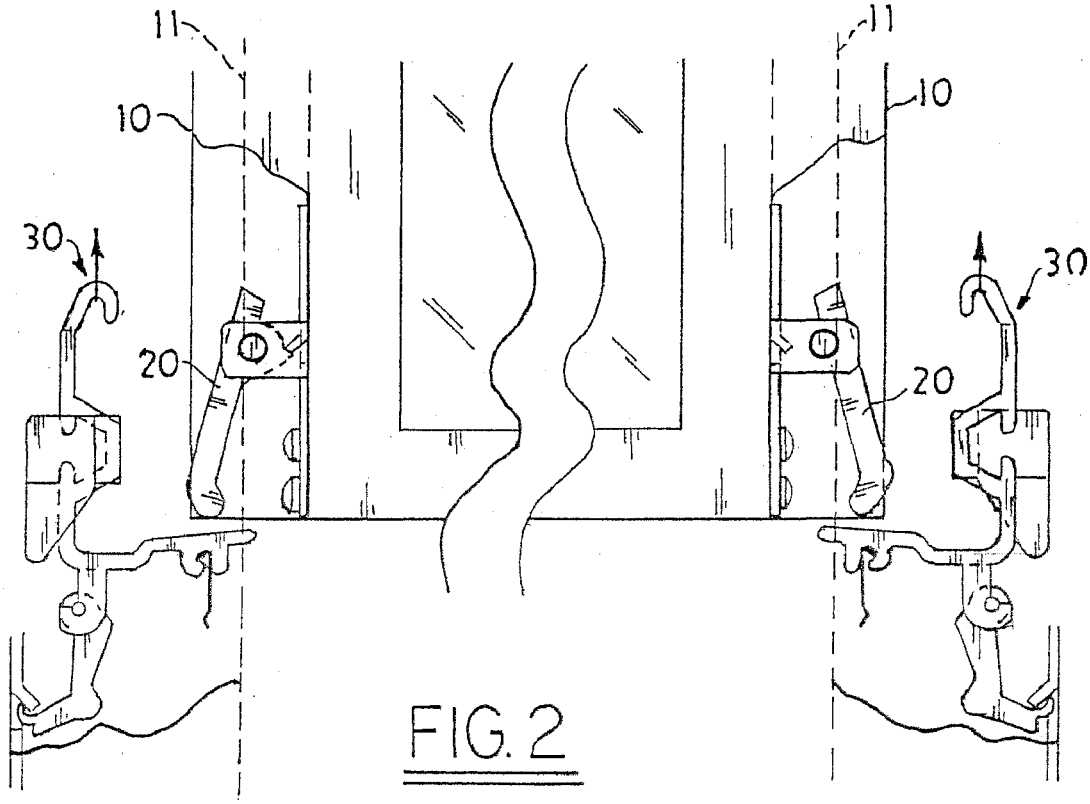
Figure 3:
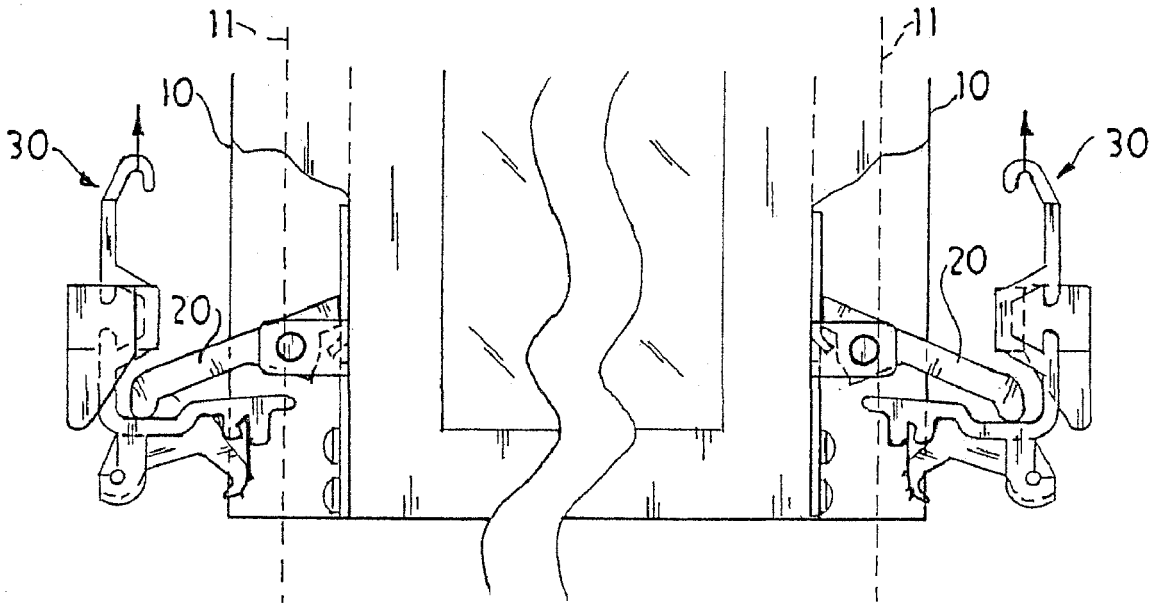

FIGS. 1 through 3 schematically illustrate the removal and replacement of a sash supported by the inventive system of U.S. Pat. No. 6,948,279 with the sash moved laterally for removal or insertion in FIG. 1, lifted above or lowered onto counterbalance shoes in FIG. 2, and supported on counterbalance shoes in FIG. 3.

Figure 4:
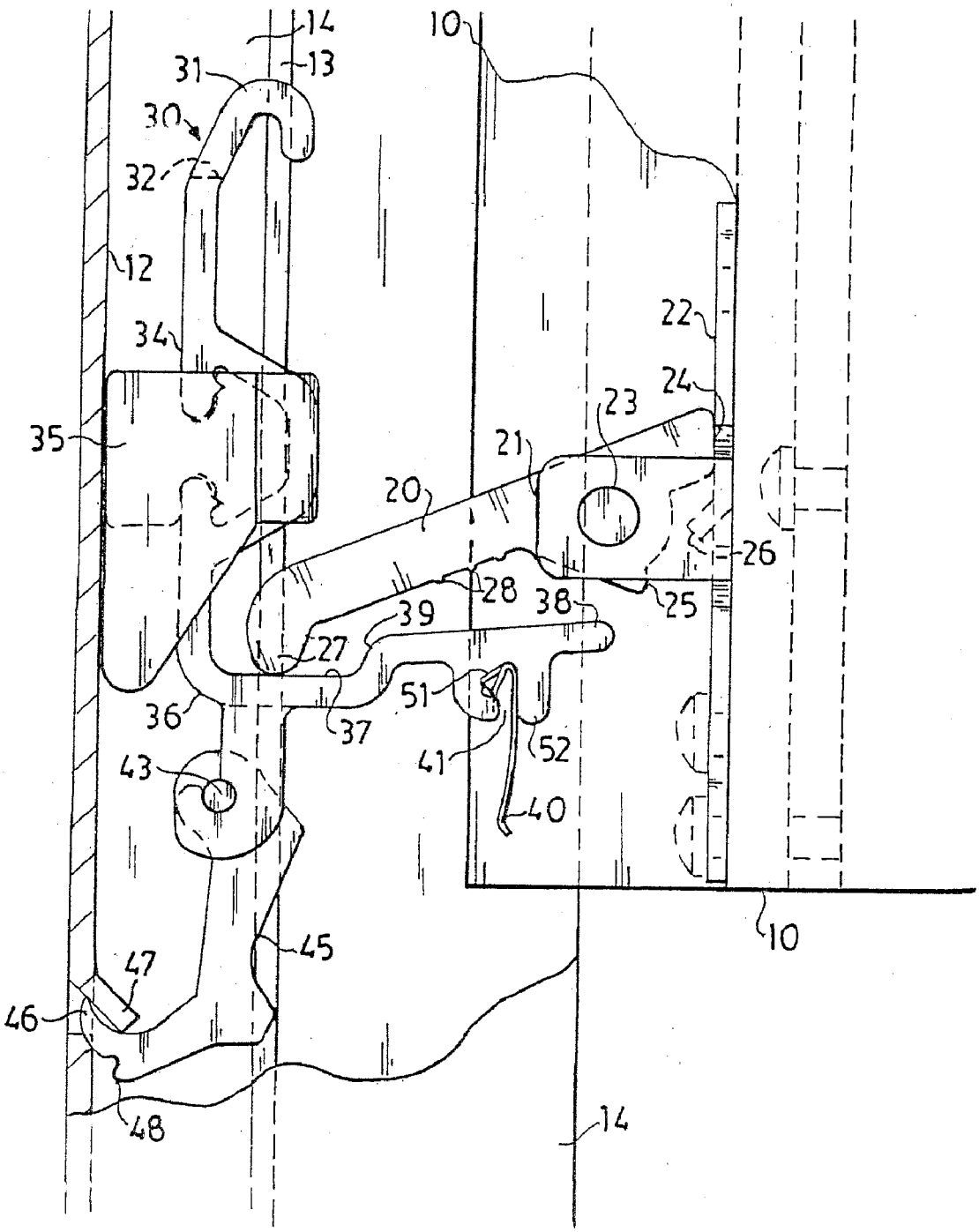
Figure 5:
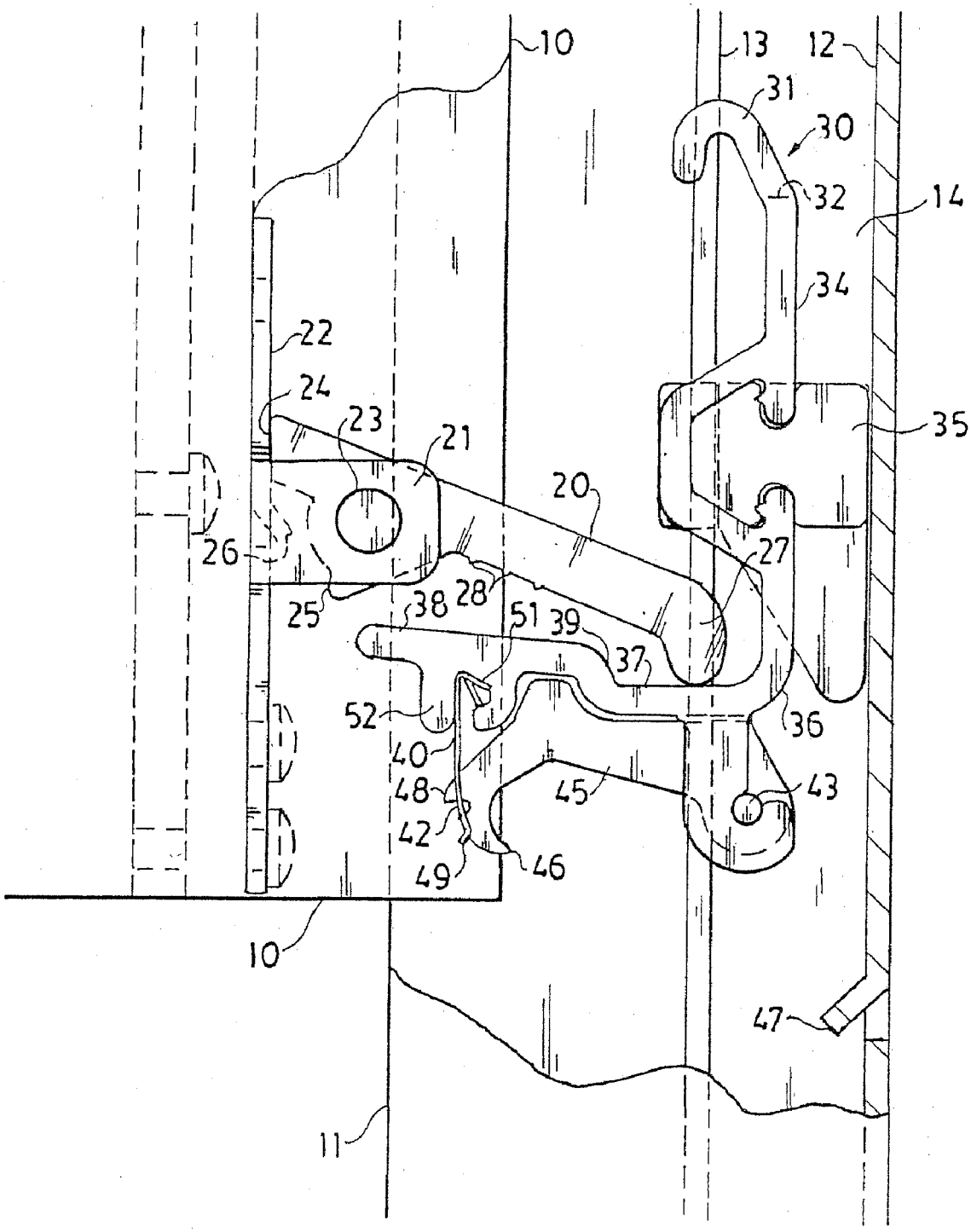

FIGS. 4 and 5 are partially cut-away elevational views showing preferred embodiments of sash support arms and counterbalance shoes of U.S. Pat. No. 6,948,279 with a shoe locked in a jamb in FIGS. 4 and unlocked from a jamb in FIG. 5.

FIGS. 6A through 10 illustrated a preferred embodiment incorporating an improved system for shoe latching in laterally removable sash in accordance with the teachings of the instant invention.

Figure 6A:
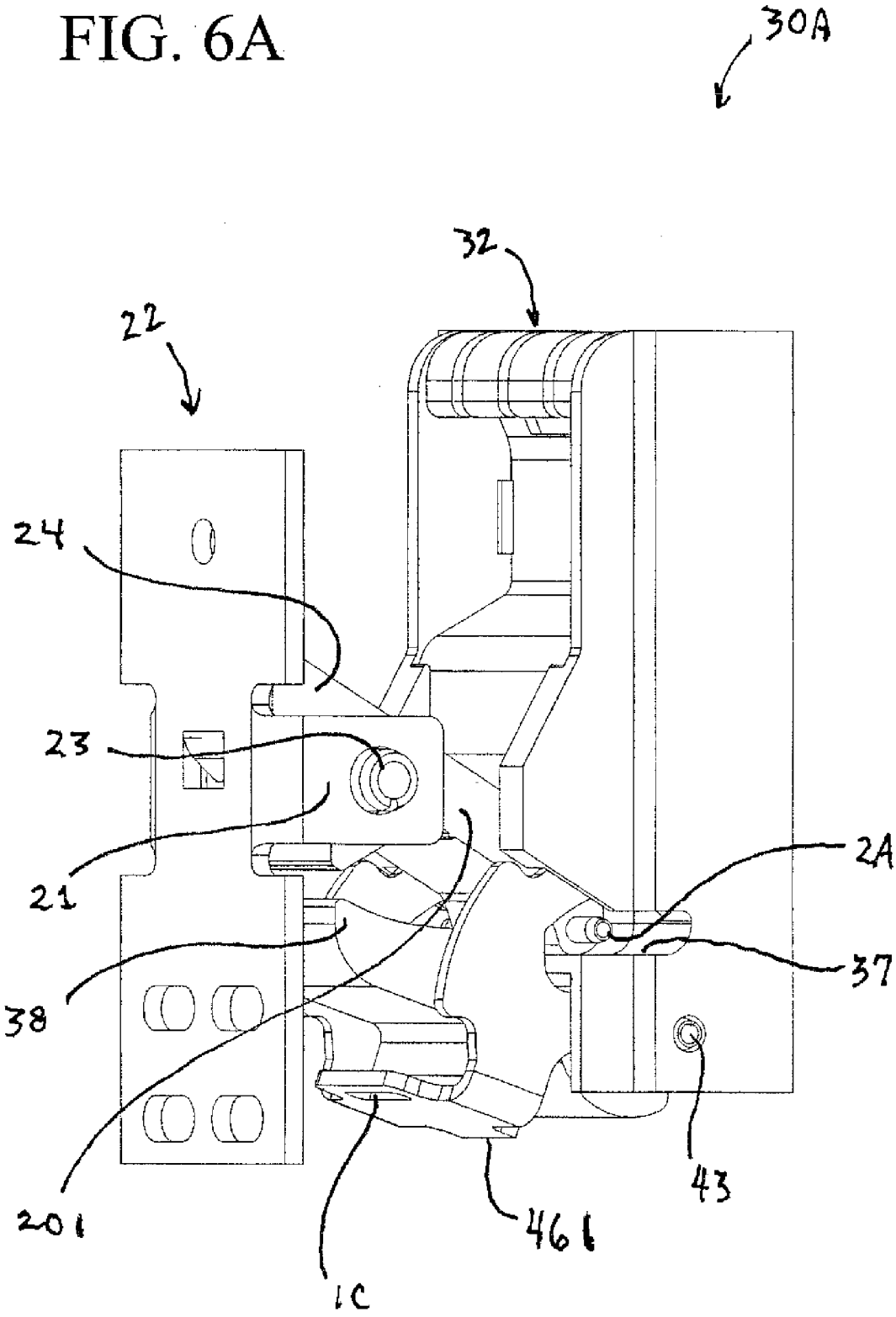

FIG. 6A provides a first perspective view of a preferred embodiment incorporating the teachings of the instant invention.

Figure 6B:
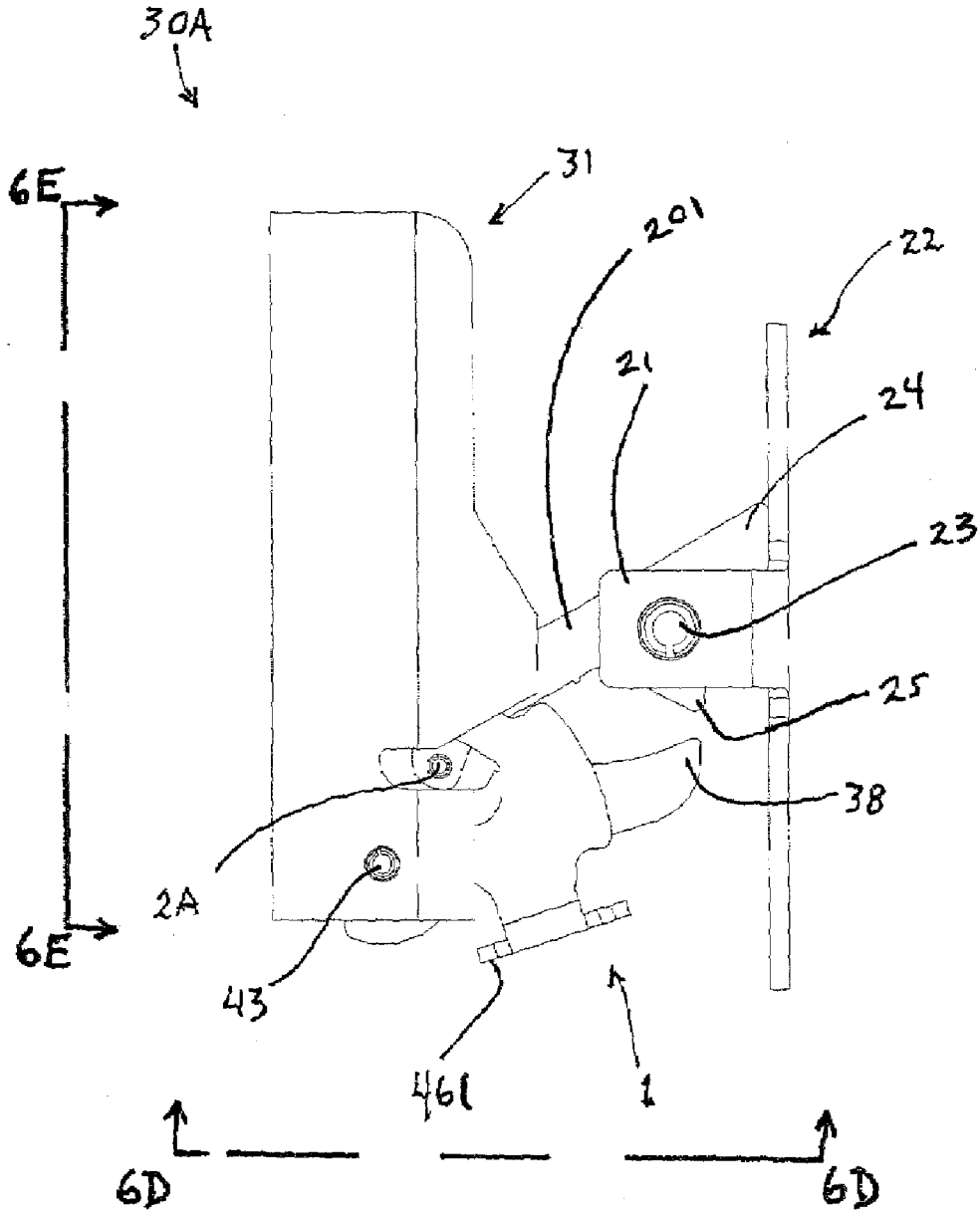

FIG. 6B provides a first side view of a preferred embodiment incorporating the teachings of the instant invention.

Figure 6C:
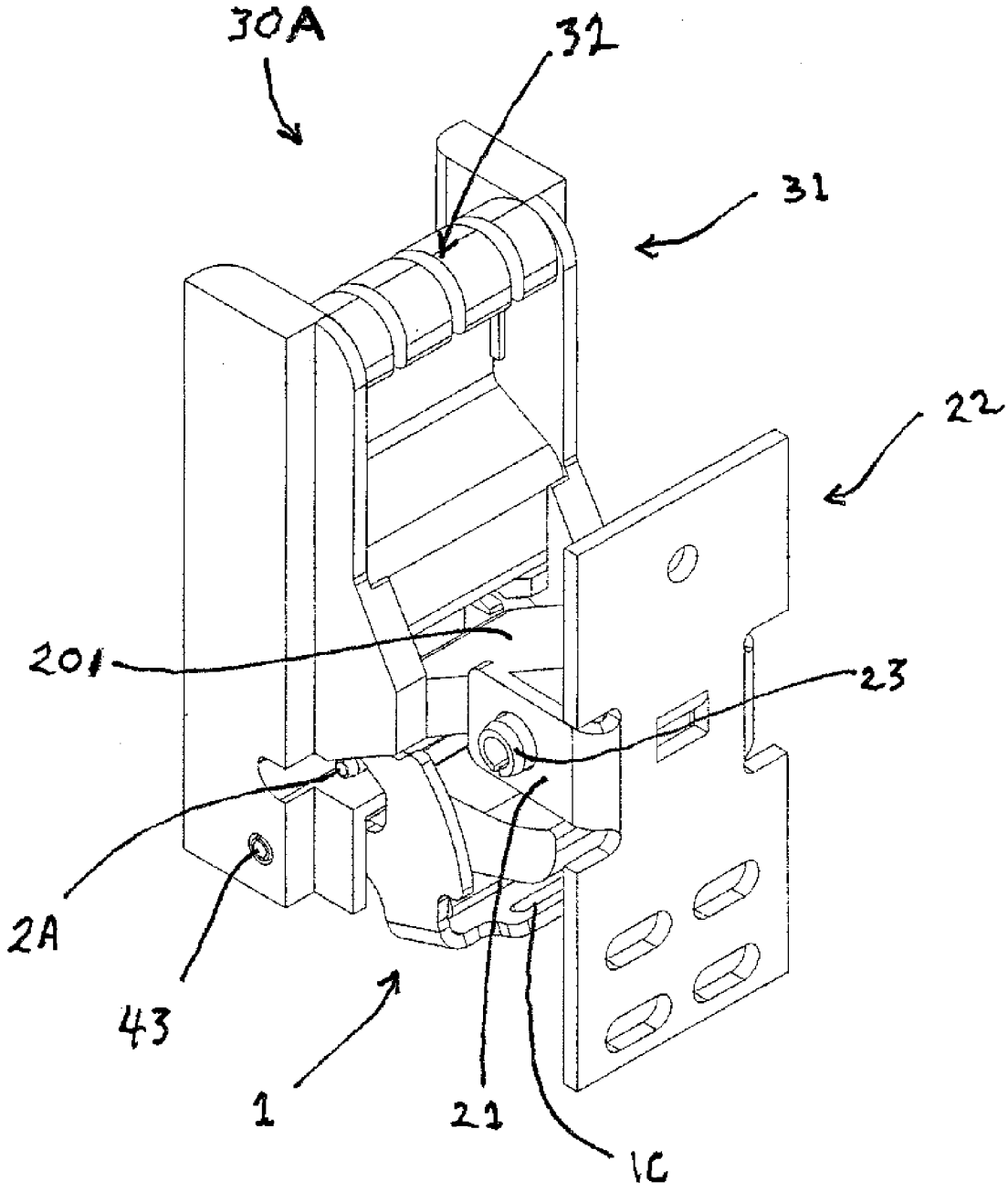

FIG. 6C provides a second perspective view of a preferred embodiment incorporating the teachings of the instant invention.

Figure 6D:
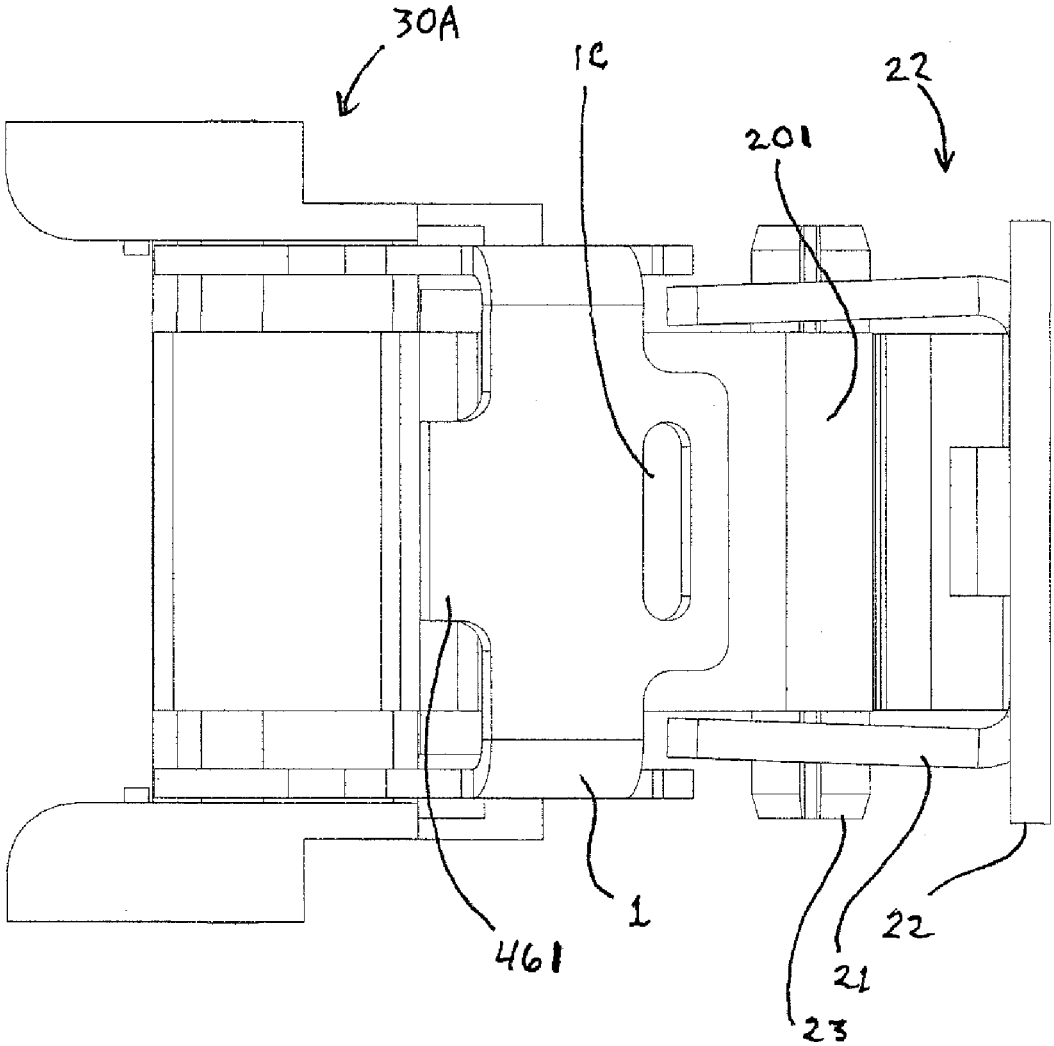

FIG. 6D provides a view from 6D—6D of FIG. 6B of the preferred embodiment incorporating the teachings of the instant invention.

Figure 6E:
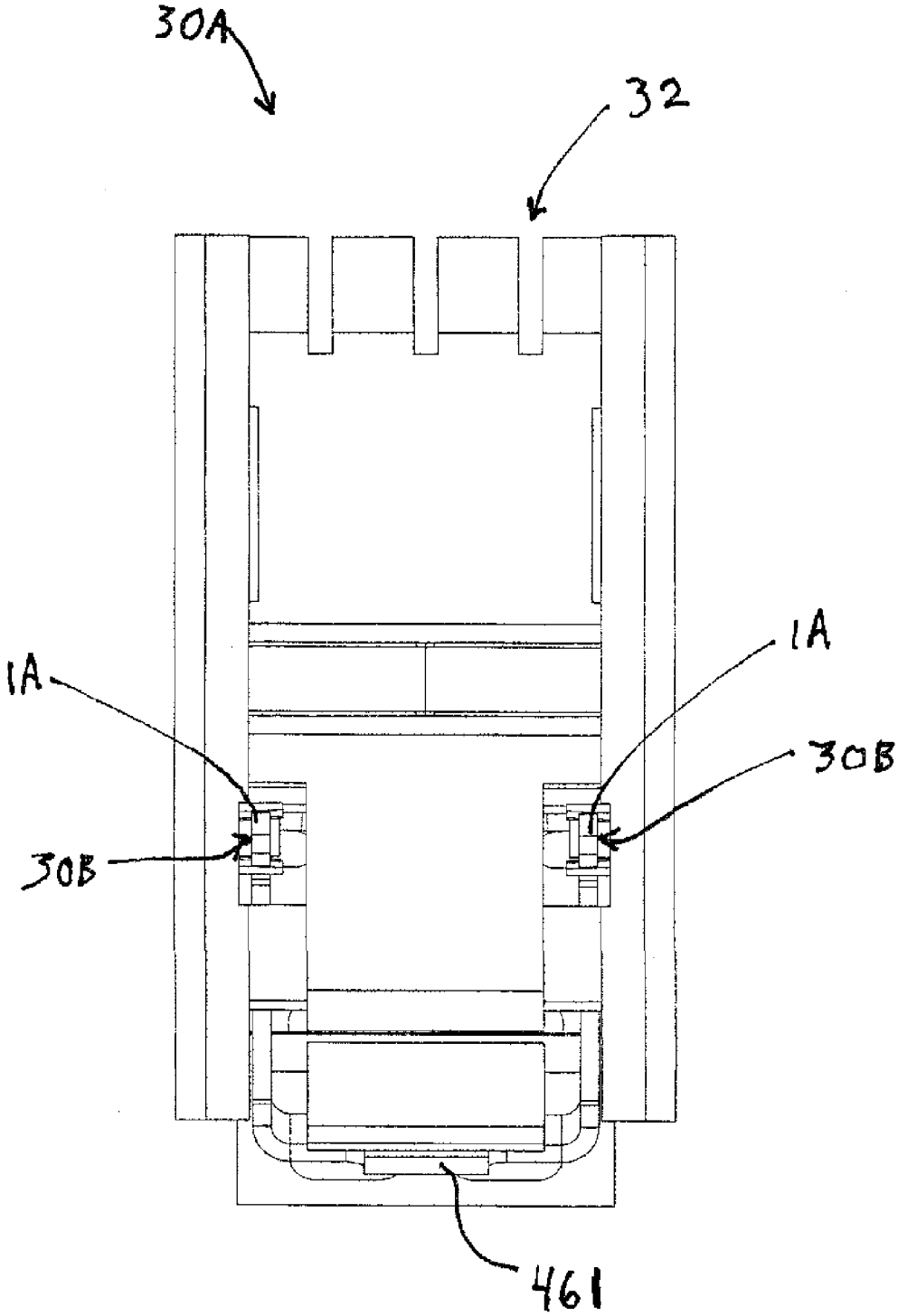

FIG. 6E provides a view from 6E—6E of FIG. 6B of the preferred embodiment incorporating the teachings of the instant invention.

Figure 7:
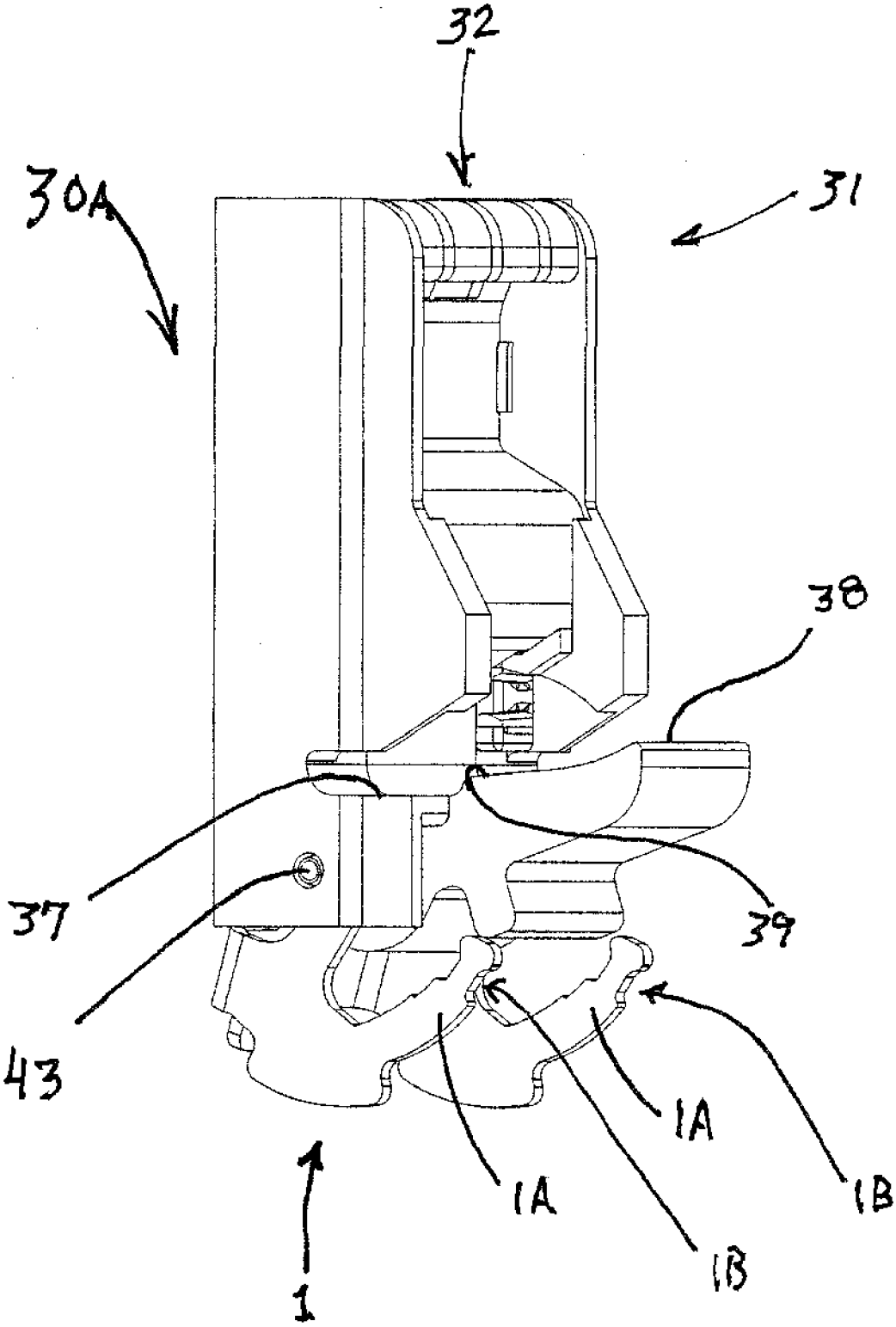

FIG. 7 provides a perspective view of the shoe illustrated in FIGS. 6A through 6E.

Figure 8:
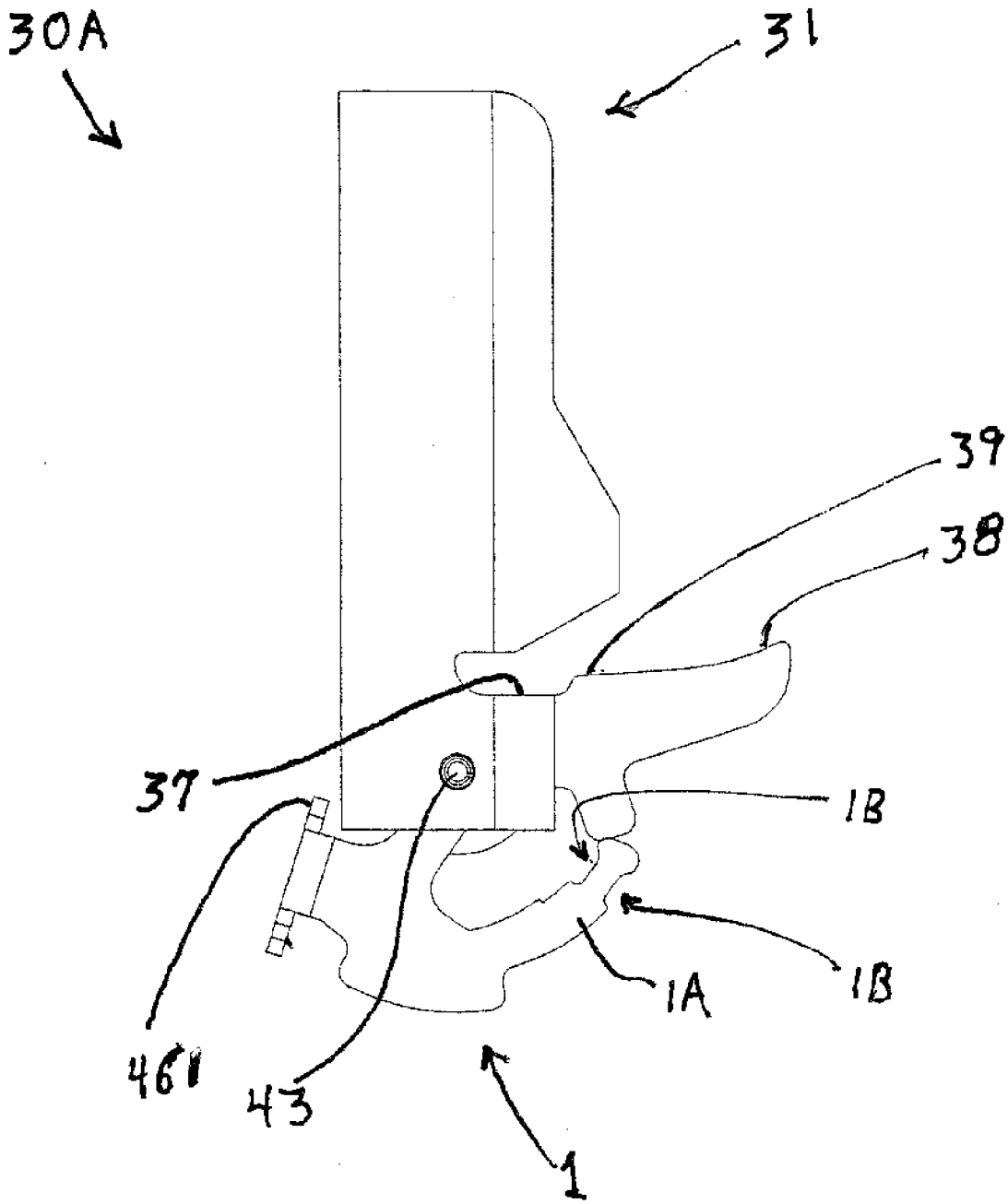

FIG. 8 provides a side view of the shoe illustrated in FIGS. 6A through 6E.

Figure 9:
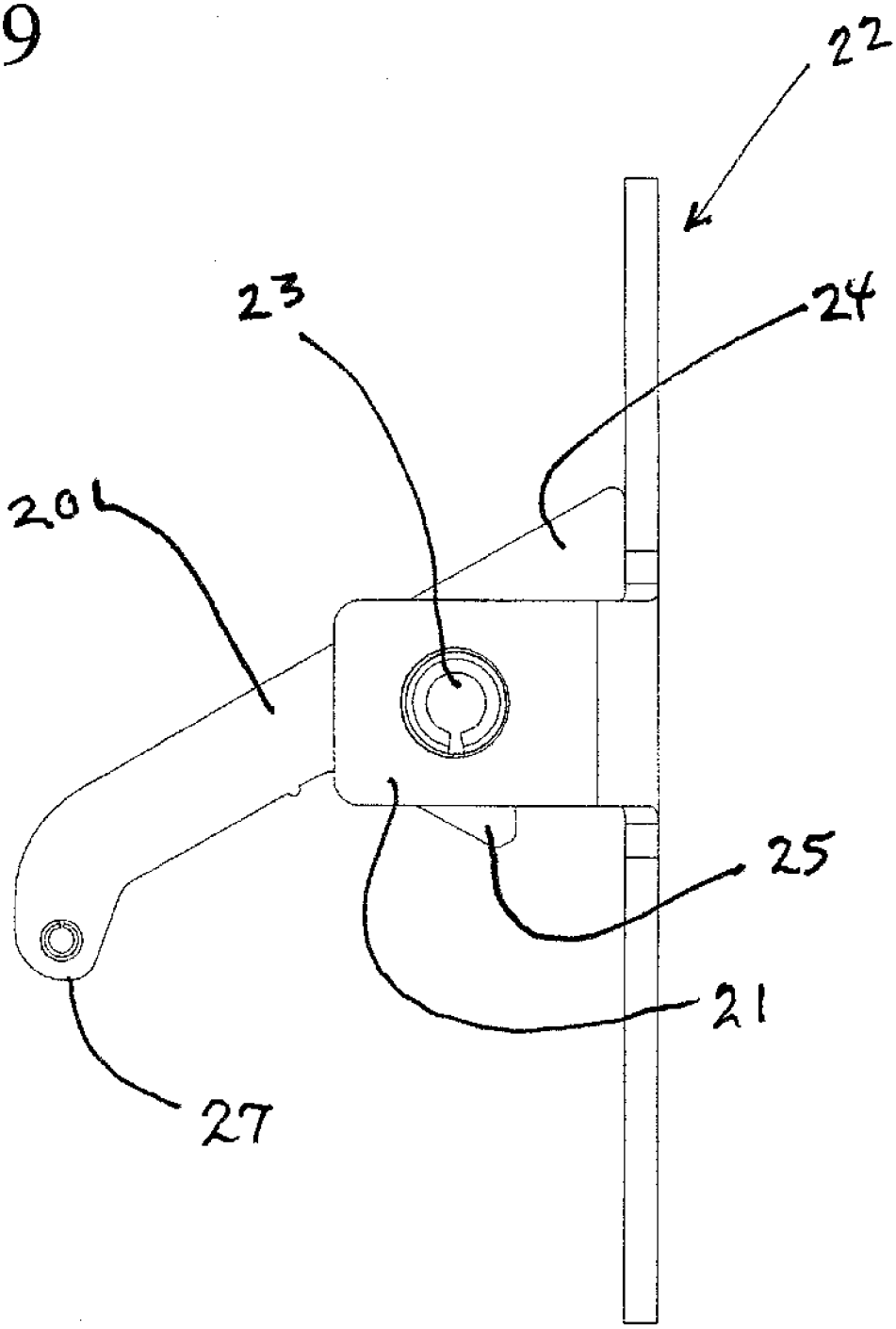

FIG. 9 provides a side view of the bracket and support arm illustrated in FIGS. 6A through 6E.

Figure 10:
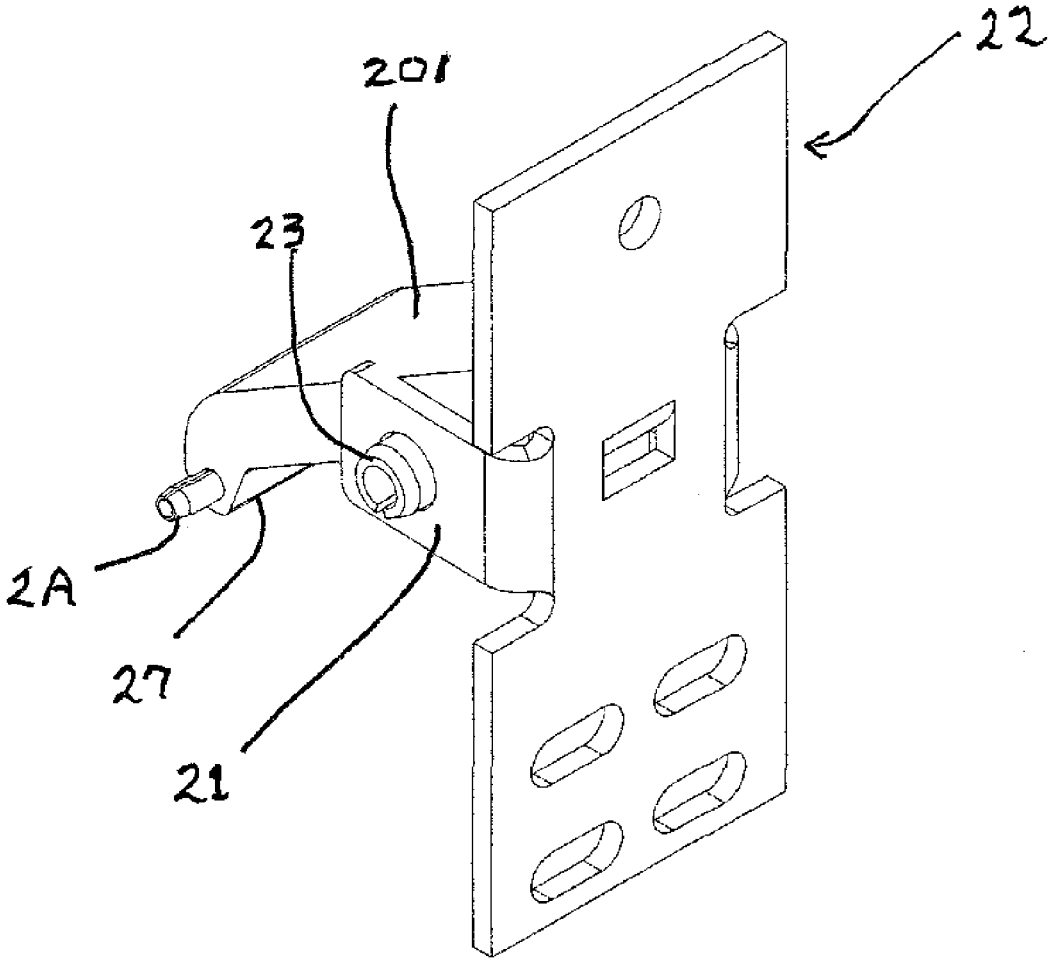

FIG. 10 provides a perspective view of the bracket and support arm illustrated in FIGS. 6A through 6E

DETAILED DESCRIPTION

A sash supported according to this invention is laterally removable from between a pair of opposed window jambs in a way that is similar to the sash removal shown in application Ser. No. 08/839,161, now U.S. Pat. No. 6,948,279 B1. The instant system differs from that shown in the '279 patent principally in regard to improvements related to its improved shoe locking hooks 1. Thus, in the preferred embodiments of the instant application illustrated in FIGS. 6A through 10, support arm latching members are provided on the improved hooks 1 in the form of rear extensions 1A. Rear extensions 1A latch over new interlock pins 2A provided in and extending from support arms 201 when the improved hooks 1 are disengaged from their adjacent jambs.

Therefore, the same improved hooks 1 that serve to hold improved shoes 30A in position when engaged to the jambs serve to further secure the support arms 201 for the sash in position on improved shoes 30A when disengaged from the jambs. In other respects, the preferred embodiments of the instant application and their use can be best understood by review of the more basic embodiment illustrated in FIGS. 1 through 5 and the teachings of the '279 patent.

The operation of a basic embodiment of the inventive system, as described in more detail in U.S. Pat. No. 6,948,279 is shown schematically in FIGS. 1–3. Sash 10, as shown in FIG. 1, is lifted off of shoes 30 that are locked in place within jambs 11, which are illustrated by broken lines extending along the light opening between jambs 11. For heavy sash that benefit from the inventive support system, jambs 11 are generally extruded of metal to allow lateral room for maneuvering sash 10 in between and out from between jambs 11. Jambs 11 are essentially the same as jambs used with the sash support system of the '795 patent, and such jambs are available in different dimensions to accommodate different sizes of sash 10 and corresponding counterbalance systems. Sash 10, in the position shown in FIG. 1, is also moved laterally within jambs 11 to free one stile edge of sash 10 from jambs 11 for maneuvering sash 10 out from between jambs 11 or back into a position between jambs 11.

In the position shown in FIG. 2, sash 10 is centered between jambs 11 but elevated above locked shoes 30, as it is lifted off from or lowered onto shoes 30. In the position shown in FIG. 3, sash 10 is again centered between jambs 11, but is lowered onto shoes 30, which are no longer locked within jambs 11. In the supported position shown in FIG. 3, sash 10 rests on and is supported by shoes 30 by means of sash support arms 20 that are moved to an outward position. Arms 20 are in inward positions when sash 10 is lifted off of shoes 30, as shown in FIGS. 1 and 2.

Besides the preferred pivoting of sash support arms 20 on the stiles of sash 10, as illustrated in FIGS. 1–3, it is also possible to arrange sash support arms that are pivotally mounted on shoes 30. Preferably a mid region 34 of shoe 30 has a groove that receives and holds a guide block 35. Guide block 35 gives shoe 30 a smooth running fit within a channel 14 formed behind fins 13 in a rear region of jamb 11 spaced outward from sash 10. With such an arrangement, shoe mounted sash support arms would pivot inward to engage sash stiles and support the weight of a sash engaged by the arms, which are preferably braced against pivoting when in a support position. Pivoting the support arms on the shoes can thus achieve a similar result to the preferred pivoting of the support arms on the sash stiles. Either way, the support arms transfer the sash weight to the shoes and move from sash support positions when the sash is uplifted from the shoes, to allow lateral movement and withdrawal of the sash from the jambs.

As best shown in FIGS. 4 and 5, support arms 20 are pivotally mounted on brackets 21 of mounts 22 that are secured to the stiles of sash 10, which have a recessed edge groove that receives mount brackets 22. Pivot pins 23 support arms 20 on brackets 21 to pivot between outwardly extending positions shown in FIGS. 4 and 5, and downwardly dependent positions shown in FIGS. 1 and 2. Each of these positions is limited and braced by mount 22. In the outwardly extending position, an end 24 of arm 20 abuts against mount 22 to brace arm 20 against pivoting upward. To distinguish between support arms 20 of different lengths, the arms are preferably formed with extruded coding lines 28. In the downwardly dependent position, an abutment 25 on support arm 20 engages a lance 26 on mount 22 to prevent pivoting of support arm 20 downward or inward beyond the position shown in FIG. 10.

A lower region 36 of shoe 30 has a sash support platform 37 that is engaged by the ends 27 of sash support arms 20 to uphold the weight of sash 10. Platforms 37 extend toward sash 10 far enough to engage sash support arms 20 in their inward positions. The extension of platforms 37 towards sash 10 also leaves free room above platforms 37 for sash 10 to be moved laterally while it is raised above platforms 37 and maneuvered out of or into the space between opposed jambs 11. As a sash 10 is lowered into a supported position on shoes 30, the ends 27 of support arms 20 first engage inner end regions 38 of support platforms 37; and then as sash 10 is further lowered, arm ends 27 slide outward along platforms 37 to the support position illustrated in FIGS. 4 and 5. The reverse occurs as sash 10 is lifted up off of shoes 30.

The small step 39 in platform 37 is preferred for resisting lateral movement of sash 10 while resting on shoes 30 and as a positive indication that arm ends 27 of a sash being lowered have reached appropriately supported positions on platforms 37. The regions where arm ends 27 support sash 10 on platforms 37 are preferably directly below slots 32 where counterbalance elements exert an upward force on upper regions 31 of shoes 30. This minimizes any moment arms tending to turn shoes 30 around horizontal axes.

Below platform 37 is preferably arranged a pivot pin 43 for a shoe-locking hook. In FIGS. 1 through 5, illustrating the exemplary teachings of a basic embodiment of the invention (as more thoroughly taught and described in the '279 patent), this shoe-locking hook is hook 45. Hook 45 has a latching nose 48 that latches into an opening 42 in spring 40. In the preferred embodiment of the instant invention, as illustrated in FIGS. 6A through 10, this is improved hook 1. In either, a hook end 46 interlocks with a projection or lance 47 formed in jamb wall 12, as illustrated in FIG. 4.

In the basic embodiments illustrated in FIGS. 1 through 5, the underside of the inward region 38 of support platform 37 has a groove 41 that receives and retains a resilient latch spring 40. An anchored end 51 of spring 40 can be pressed into slot 41 of the basic embodiment to retain spring 40 frictionally in place. In the basic embodiments, a downwardly extending projection 52 engages spring 40 to prevent movement beyond a resilient latching position, as illustrated. Hook 45 of the basic embodiment has a latching nose 48 that latches into an opening 42 in spring 40, as illustrated in FIG. 5. Latching nose 48 and spring 40 are preferably configured so that shoe-locking hook 45 can be manually pushed into the latched position shown in FIG. 5. Unlatching hook 45 for deployment preferably requires pressing a screwdriver blade in between hook end 46 and the free end 49 of spring 40. This makes the accidental deployment of hooks 45 of the basic embodiment unlikely.

In the preferred embodiment illustrated in FIGS. 6A through 10, support arm latching members are provided on improved hooks 1 in the form of rear extensions 1A. At the opposite end of hook 1 from rear extensions 1A is hook end 461. Rear extensions 1A can be latched over interlock pins 2A provided in and extending from the sides of support arms 201 when the improved hooks 1 are disengaged from their adjacent jambs. (This serves to hold the support arms 201 in place on improved shoes 30A, supplementing the weight of the sash in accomplishing this purpose). Thus, the same improved hooks 1 that serve to hold improved shoes 30A in position when engaged to the jambs serve to further secure the support arms 201 for the sash in position on improved shoes 30A when disengaged and swung away from the jambs and over interlock pins 2A.

Fasteners are also provided to hold rear extensions 1A in latched position over interlock members (pins 2A). In the preferred embodiments illustrated, these fasteners include notches 1B near the ends of extensions 1A that snap into spring loaded snaps 30B provided in improved shoes 30A. The fastener formed by the combination of notches 1B and snaps 30B is intended to be, and is, very strong so as to prevent casual release of improved hooks 1 (by, for example, school children). A slot 1C is provided in improved hooks 1 for the insertion of a screw driver head or other tool to force the release of notches 1B from snaps 30B so as to allow improved hooks 1 to attach to adjacent jambs. However, numerous changes can be made in the structure of the foregoing elements (as with other elements herein described) without exceeding the ambit of the inventive concept. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A system supporting a sash that is laterally removable from between opposed window jambs, the system comprising:

a. a pair of sash support arms mounted to hang freely downward on respective opposite stiles of the sash and to pivot from downwardly hanging positions to outwardly extended positions that the support arms assume when supporting the sash;

b. the sash support arms in the downwardly hanging positions being disposed so that as the sash is lowered toward a supported position, the downwardly hanging arms engage sash supporting platforms of counterbalanced sash shoes locked into the jambs so that sash lowering engagement between the arms and the platforms pivots the arms outward along the platforms toward the outwardly extended positions; and c. the shoes including locking elements deployable to lock the shoes to jamb projections during removal and replacement of the sash from the window jambs, the locking elements also being deployable to engage pins extending from the support arms so as to lock the sash support arms on the shoes when not deployed to lock the shoes to said jamb projections.

2. The system of claim 1, wherein said locking elements are pivotally mounted on said shoes, and can be pivoted in one direction to engage the jamb projections and pivoted in another direction to lock the support arms on the shoes.

3. The system of claim 2, further including fasteners for holding said locking elements in position locking the sash support arms on the shoes and holding said locking elements out of position to lock the shoes to said jamb projections.

4. The system as described in claim 3, wherein said fasteners include rear extensions of said locking elements.

5. The system as described in claim 4, wherein notches on said rear extensions snap into snaps provided on said shoes.

6. The system of claim 3, wherein said fasteners include snaps on said shoes.

7. The system as described in claim 6, wherein said fasteners include notches on rear extensions of said locking elements that snap into the snaps provided on said shoes.

8. The system as described in claim 2, wherein said locking elements include rear extensions that are used to engage the pins so as to hold said support arms on said shoes.

9. The system as described in claim 1, wherein said locking elements include rear extensions that are used to engage the pins so as to hold said support arms on said shoes.

10. The system of claim 1, further including fasteners for holding said locking elements in position locking the sash support arms on the shoes and holding said locking elements out of position to lock the shoes to said jamb projections.

11. The system as described in claim 10, wherein said fasteners include rear extensions of said locking elements.

12. The system as described in claim 11, wherein notches on said rear extensions snap into snaps provided on said shoes.

13. The system of claim 10, wherein said fasteners include snaps on said shoes.

14. A system as described in claim 13, wherein said fasteners include notches on rear extensions of said elements that snap into the snaps provided on said shoes.

15. A system selectively locking counterbalance shoes to window jambs while a sash supported on the shoes is removed from between the window jambs, the system comprising:

a. the shoes having hooks that are pivotally mounted on lower regions of the shoes below sash supporting platforms of the shoes and the sash is supported on the platforms by sash support arms;

b. the hooks in unfastened positions hang dependently downward from the shoes below the sash supporting platforms such that the hooks are disposed to hook under lances formed in the jambs as the shoes rise; and c. the hooks in fastened positions being retained out of engagement with the jambs and clear of the lances by engaging pins extending from said support arms, and retaining the support arms on the shoes.

16. The system of claim 15, wherein said sash support arms are mounted to respective opposite stiles of the sash and to pivot from said unfastened positions to outwardly extended positions that the support arms assume when supporting the sash; and wherein the sash support arms in the unfastened positions are disposed so that as the sash is lowered toward a supported position, the arms engage sash supporting platforms of said counterbalance shoes locked into the jambs so that sash lowering engagement between the arms and the platforms pivots the arms outward along the platforms toward said extended position.

17. The system as described in claim 16, wherein rear extensions of the hooks engage said pins.

18. A system as described in claim 17, wherein notches on said rear extensions snap into snaps provided on said shoes.

19. The system as described in claim 15, wherein rear extensions of the hooks engage said pins.

20. The system as described in claim 19, wherein notches on said rear extensions snap into snaps provided on said shoes.

* * * * *